US006196366B1

(12) United States Patent
Lin

(10) Patent No.: US 6,196,366 B1
(45) Date of Patent: Mar. 6, 2001

(54) FOLDABLE SUITCASE HAVING RETRACTABLE HANDLE DEVICE

(76) Inventor: Chao Chin Lin, P.O. Box 63-99, Taichung, 406 (TW)

( * ) Notice: Subject to any disclaimer, the term of this patent is extended or adjusted under 35 U.S.C. 154(b) by 0 days.

(21) Appl. No.: 09/425,113

(22) Filed: Oct. 20, 1999

Related U.S. Application Data

(63) Continuation-in-part of application No. 09/138,042, filed on Aug. 19, 1998, now Pat. No. 6,047,798.

(51) Int. Cl.[7] ..... A45C 5/14; A45C 7/00; A45C 13/26

(52) U.S. Cl. ..... 190/18 A; 190/39; 190/103; 190/115; 16/115; 280/37

(58) Field of Search ..... 190/18 A, 39, 190/103–105, 107, 115; 280/37; 16/115.1

(56) References Cited

U.S. PATENT DOCUMENTS 4,361,215 * 11/1982 Sawai ..... 190/103 X
5,251,731 * 10/1993 Cassese et al. ..... 190/107
5,323,387 * 6/1994 Scicluna et al. ..... 189/1 A
5,374,073 * 12/1994 Hung Hsin ..... 190/18 A X
5,664,652 9/1997 Shamah ..... 190/18 A
5,709,398 * 1/1998 Lu ..... 190/115 X
5,713,502 * 2/1998 Dixon ..... 190/103 X
5,819,891 * 10/1998 Wang et al. ..... 190/103

FOREIGN PATENT DOCUMENTS

395247 * 8/1928 (GB) ..... 190/105

* cited by examiner

*Primary Examiner*—Sue A. Weaver
(74) *Attorney, Agent, or Firm*—Charles E. Baxley

(57) ABSTRACT

A foldable suitcase has a foldable middle disposed between a base and an upper shell, a wheel device secured to the base, and a retractable support having a pair of posts secured to the base and a pair of tubes slidably received in the posts and having an upper portion secured to the upper shell for supporting the suitcase at a working position and a folded position. A fixed or extendible handle device is further attached to the upper shell for carrying the suitcase. The posts are secured in the suitcase for allowing the zippers of the suitcase to be easily operated by the users.

1 Claim, 12 Drawing Sheets

FOLDABLE SUITCASE HAVING RETRACTABLE HANDLE DEVICE

The present invention is a continuation-in-part of U.S. patent application Ser. No. 09/138,042, filed Aug. 19, 1998, now U.S. Pat. No. 6,047,798.

BACKGROUND OF THE INVENTION

1. Field of the Invention

The present invention relates to a luggage article or a suitcase, and more particularly to a luggage article or a suitcase having a retractable and/or foldable handle device.

2. Description of the Prior Art

Typical foldable bags or suitcases or luggage articles comprise a middle portion that may be folded to a compact size for storing purposes, and a handle device provided for carrying the foldable luggage article. One of the typical foldable luggage articles is disclosed in U.S. Pat. No. 5,664,652 to Shamah and comprises a vertically expandable luggage article, and a vertically expandable handle device having at least three vertically stacked supports or tubular members secured to the luggage article. Only a rigid plate is secured to the upper portion of the top shell. When the intermediate and foldable shells of the luggage article are opened, only the right plate may be provided for supporting the top shell and the intermediate foldable shells are expanded to the working position, such that the luggage article may not be stably supported in place when the luggage article is expanded.

The present invention has arisen to mitigate and/or obviate the afore-described disadvantages of the conventional foldable bags or luggage articles.

SUMMARY OF THE INVENTION

The primary objective of the present invention is to provide a foldable suitcase having a retractable handle device for stably supporting the suitcase at the expanded or open position.

In accordance with one aspect of the invention, there is provided a foldable suitcase comprising a suitcase body including a base and an upper shell and including a foldable middle portion provided between the base and the upper shell for forming a foldable structure to the suitcase body and for allowing the suitcase body to be expanded to a working position and to be folded to a folded position, the upper shell of the suitcase body including an upper portion and a lower portion, a wheel device secured to the base of the suitcase body, and a retractable support secured to the upper shell of the suitcase body for supporting the suitcase body at the working position and at the folded position respectively, the retractable support including a pair of posts having a lower portion secured to the base of the suitcase body, a pair of tubes slidably received in the posts respectively and including an upper portion secured to the upper portion of the upper shell of the suitcase body for allowing the tubes and the upper shell of the suitcase body to be moved up and down relative to the posts, and a bar secured to the lower portion of the upper shell of the suitcase body and including a pair of orifices for slidably receiving the posts respectively and for slidably securing the upper shell to the posts.

A handle device is further attached to the upper shell for carrying the suitcase and includes a pair of pipes slidably received in the tubes respectively and moved relative to the tubes between an extended position and a retracted position, and includes a hand grip provided between the pipes, and means for selectively securing the pipes at the extended position and the retracted position relative to the tubes. A bracket is secured to the upper portion of the upper shell and includes the tubes extended therefrom and slidably engaged in the posts respectively.

The foldable middle portion of the suitcase body includes one or more peripheral zipper devices, the bar and the posts are secured in the suitcase body for preventing the posts from blocking the peripheral zipper devices and for allowing the zipper devices to be easily operated by the users.

A securing means is further provided for securing the posts to the bar and includes at least one hole formed in a first of the posts, a spring-biased projection disposed in the bar and engaged with the hole of the first post for securing the first post to the bar. The bar includes at least one block secured therein for receiving the spring-biased projection.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
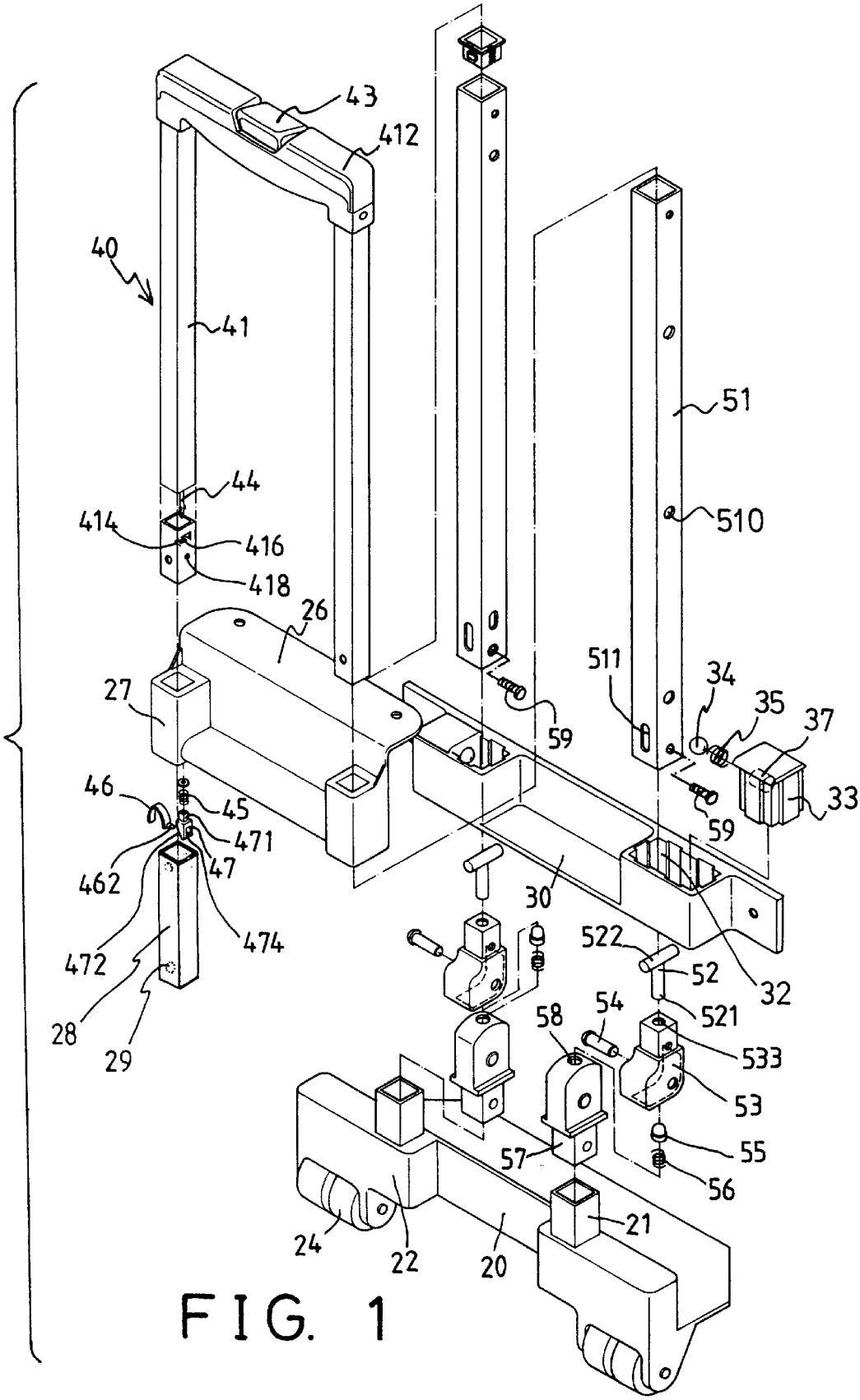
FIG. 1 is an exploded view of an expandable handle device for a foldable suitcase in accordance with the present invention.
Figure 2:
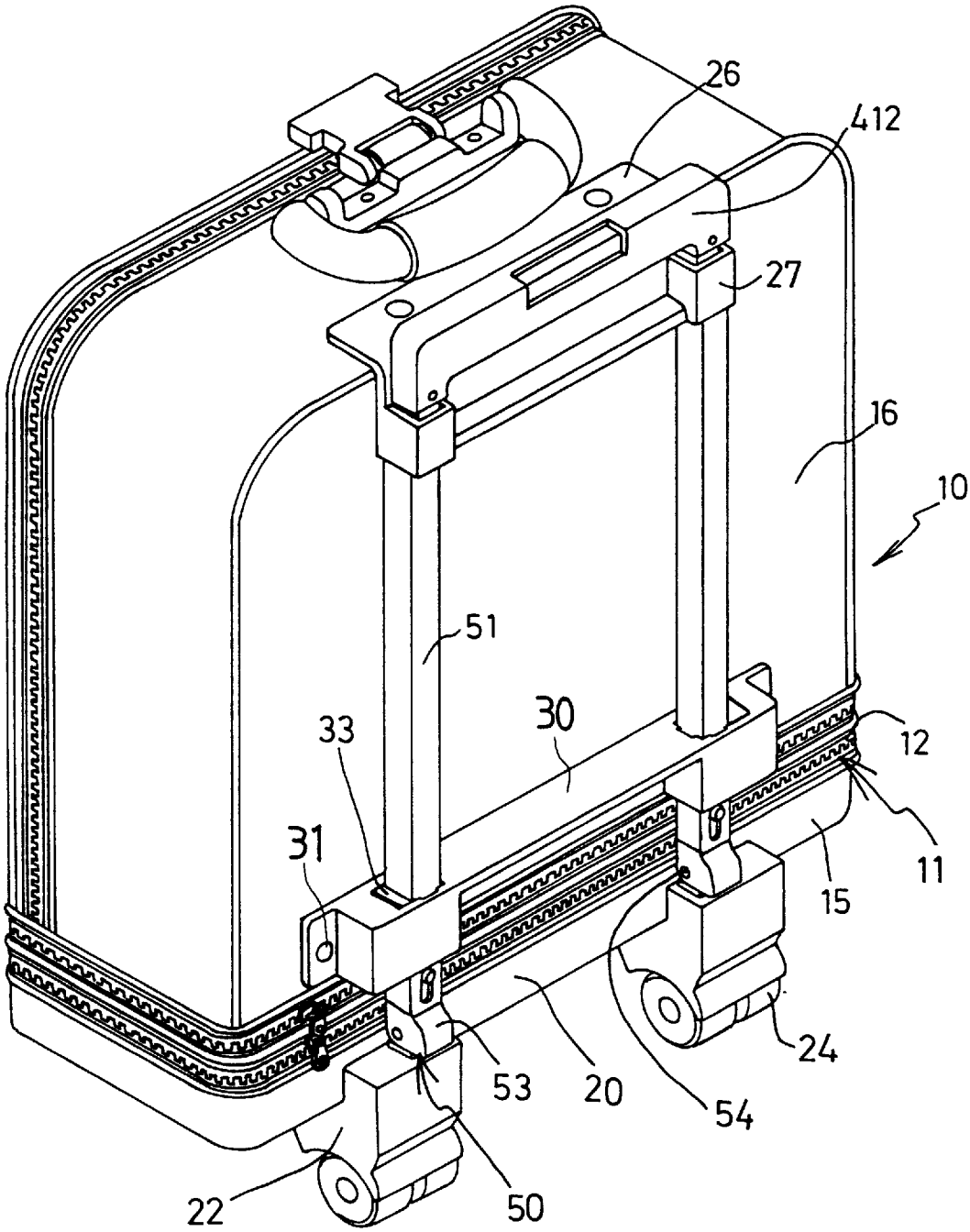
FIG. 2 is a rear perspective view of the suitcase.
Figure 3:
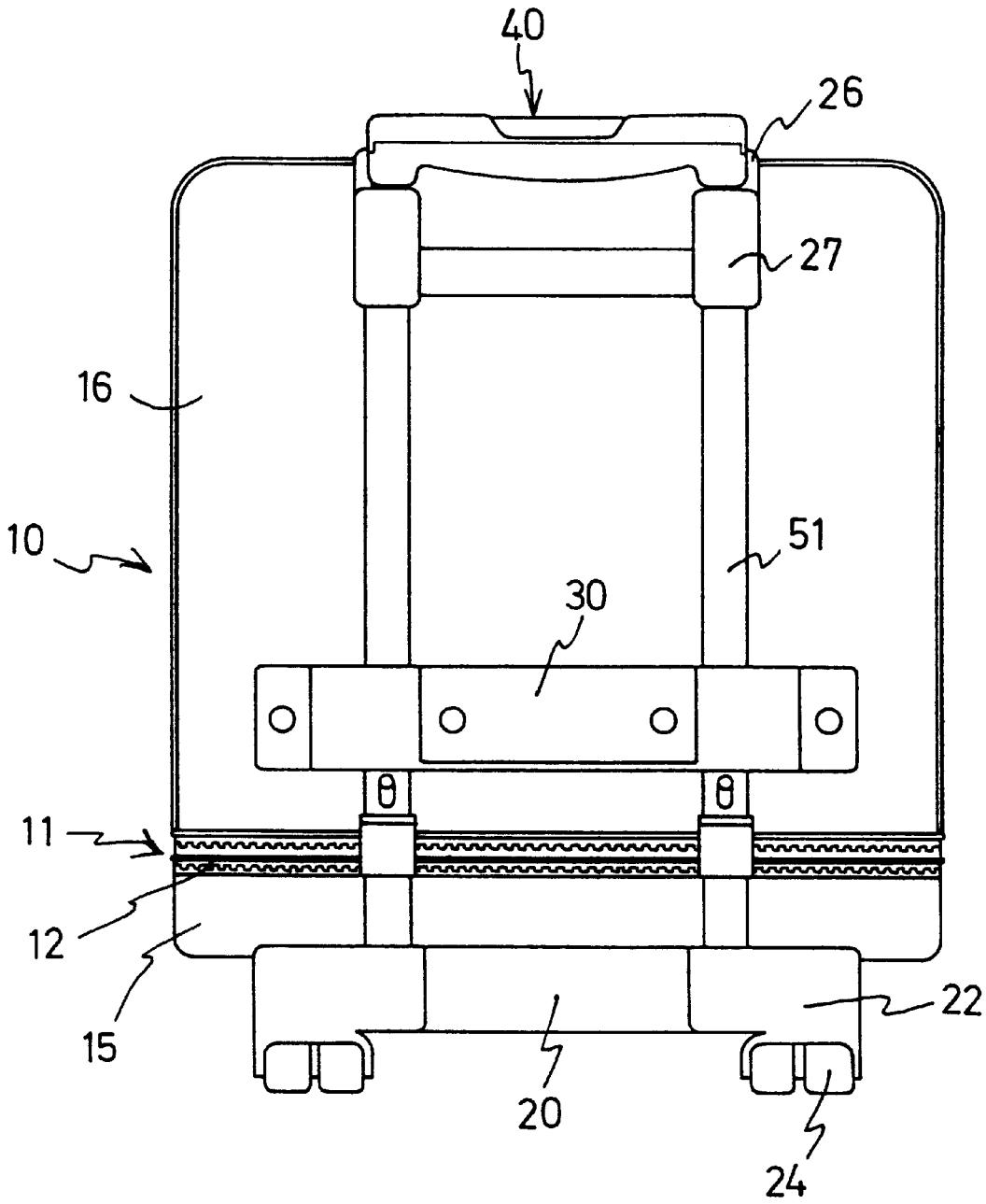
FIG. 3 is a rear view of the suitcase.
Figure 4:
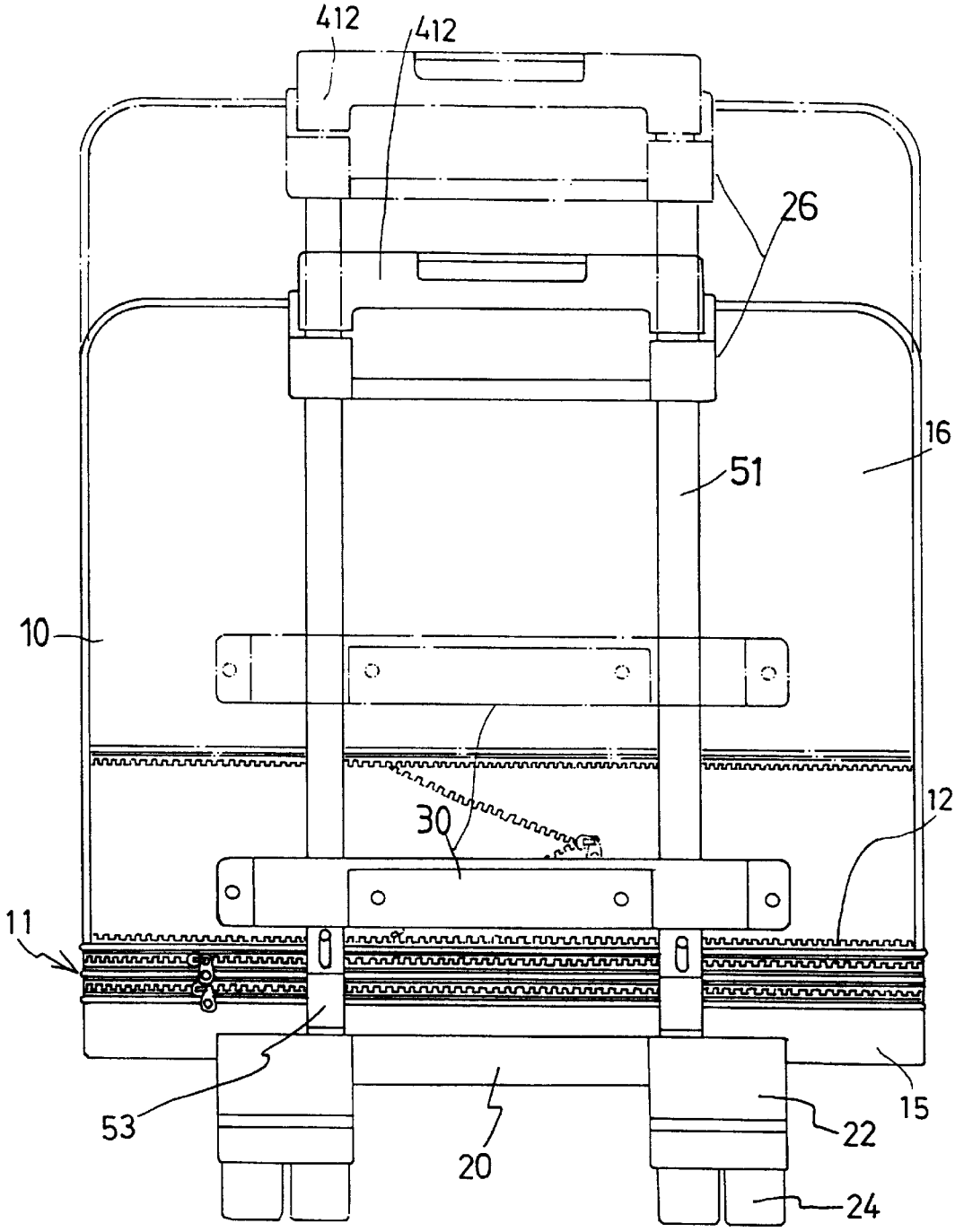
FIGS. 4, 5, 6 are rear views illustrating the operation of the foldable suitcase and the expandable handle device.
Figure 5:
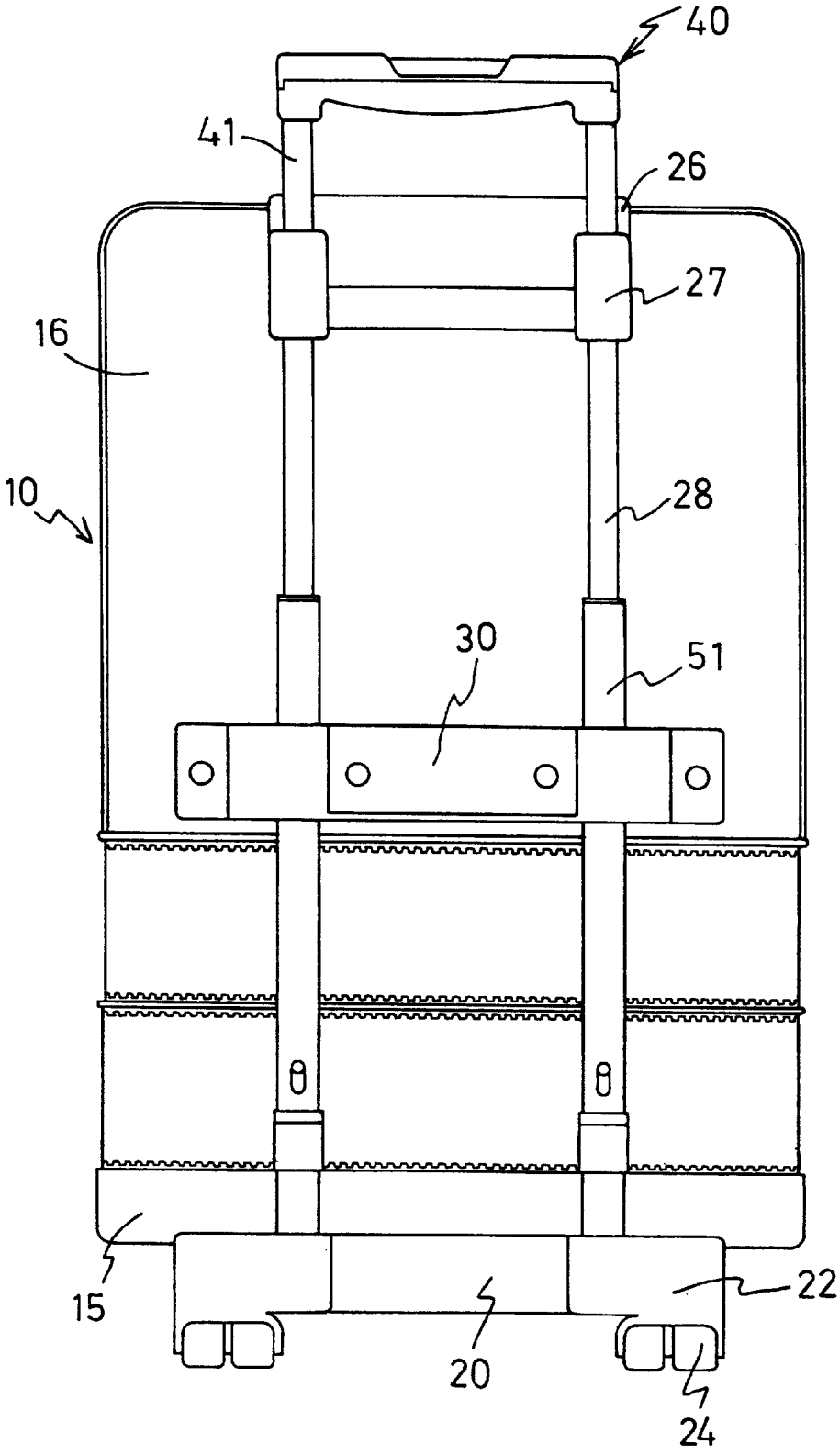

Referring to the drawings, and initially to FIGS. 2–6, a suitcase in accordance with the present invention comprises a suitcase body 10 including a foldable middle portion 11 formed between the lower shell 15 and the upper shell 16 of the suitcase body 10. One or more peripheral or helical zipper devices 12 are provided in the foldable middle portion 11 for allowing the middle portion 11 to be secured in the folded position as shown in FIGS. 2 and 3 by the zipper device 12 and to be opened or expanded to the working position as shown in FIGS. 4 and 5. The foldable structure for the suitcase is typical and will not be described in further details. The present invention is to provide a retractable or extendible handle device (FIG. 1) that is attached to the foldable suitcase for allowing the suitcase to be supported in the expanded position by the handle device. A base 20 is secured to the lower shell 15 of the suitcase body 10 for supporting one or more wheels 24 by one or more wheel cases 22. A pair of posts 51 have a lower end foldably secured to the lower shell 15 of the suitcase body 10 or preferably secured to the studs 21 that are extended upward from the wheel cases 22. One or both of the posts 51 each includes one or more holes 510 formed therein.

As shown in FIGS. 1–7, a bar 30 is secured to the lower portion of the upper shell 16 of the suitcase body 10 with fasteners 31 (FIGS. 2, 7), for example, and a bracket 26 is secured to the upper portion of the upper shell 16 of the suitcase body 10 with such as fasteners, such that the bar 30 and the bracket 26 are moved in concert with the upper shell 16 of the suitcase body 10. The bar 30 includes two orifices 32 formed therein for slidably receiving the posts 51 respectively; i.e., the posts 51 may be slided relative to the bar 30, or the bar 30 may be slided relative to the posts 51. The bracket 26 includes two sides 27 each having a tube 28 extended downward therefrom or secured thereto (FIGS. 1, 7) and slidably received in the respective posts 51. It is preferable that the sides 27 of the bracket 26 each includes a barrel formed therein or each has the tubes 28 directly extended therefrom, such that the tubes 28 may also be moved in concert with the bracket 30 and are slidably received in the respective posts 51. One or two or more blocks 33 are secured to the bar 30, and preferably secured in the orifices 32 of the bar 30 by such as fasteners or by welding processes. The blocks 33 each includes an apertures 37 laterally formed therein for receiving a spring-biased projection that includes a spring 35 and a ball 34 therein. The ball 34 is biased by the spring 35 to engage with either of the holes 510 of the posts 51 (FIG. 7) for securing and positioning the bar 30 and the upper shell 16 to the posts 51 and for securing the upper shell 16 of the suitcase body 10 relative to the base 20 and the posts 51 at any suitable or selected position, such as at the expanded working position or at the folded position.

Figure 6:
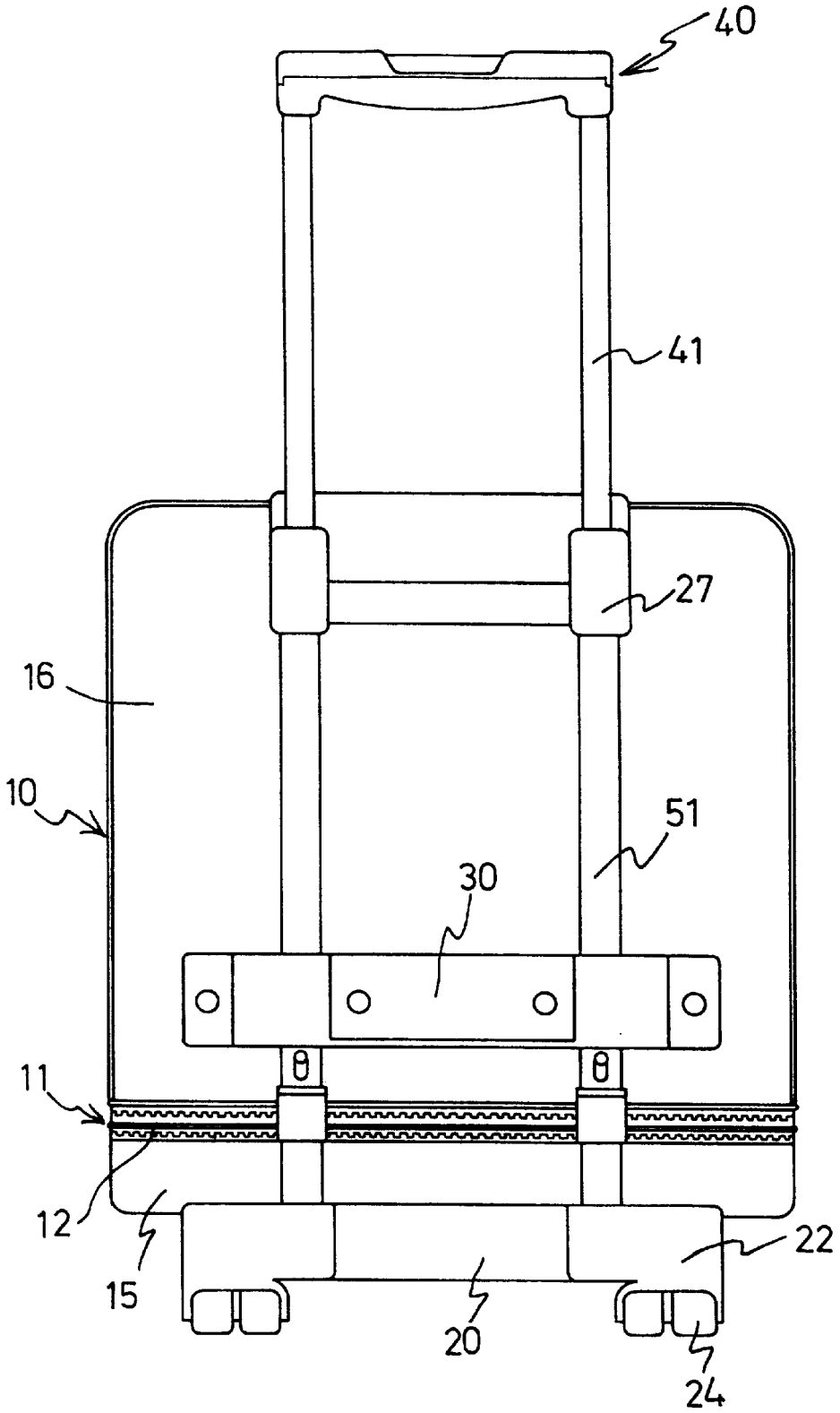
Figure 7:
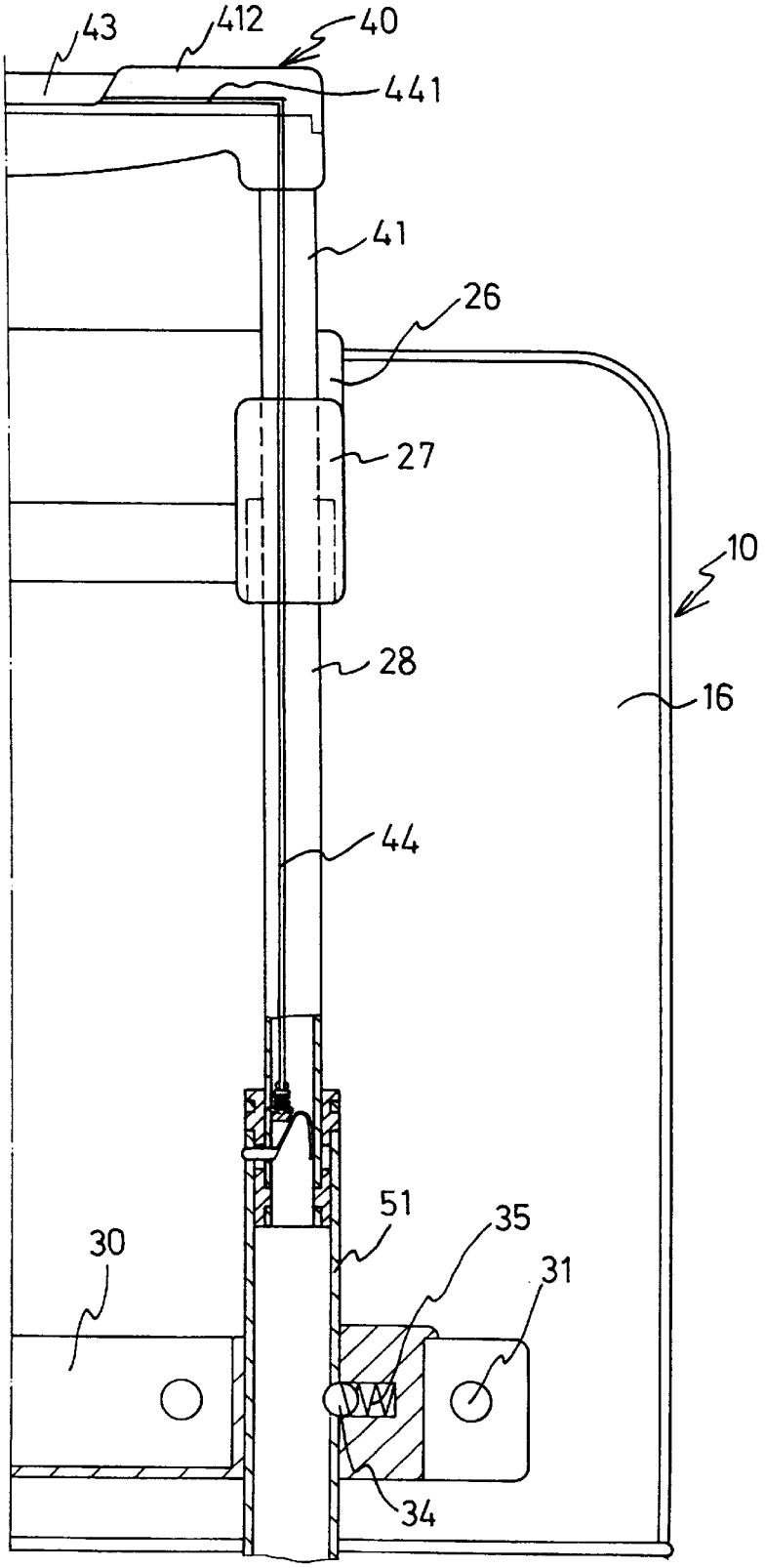
FIG. 7 is a partial cross sectional view illustrating the operation of the handle device for the foldable suitcase.

Two pipes 41 of a retractable handle device 40 are slidably received in the tubes 28 and/or the barrel-shaped sides 27 of the bracket 26 respectively and have an upper portion secured together by a handle 412. A hand grip 43 is slidably received in the handle 412 and movable up and down relative to the handle 412 or depressible inward of the handle 412. Two rods 44 are slidably received in the pipes 41 respectively and have an upper end secured to the hand grip 43 by a link 441 such that the rods 44 may be moved up and down by the hand grip 43. The pipes 41 each includes an ear 414 extended inward therefrom and having an opening 416 for slidably receiving an upward extension 471 of an actuator 47. The extensions 471 are secured to bottom of the respective rods 44 such that the actuators 47 may be moved by the hand grip 43. A spring-biased latch 46 is received in each of the pipes 41 and includes a tongue 462 extended through a hole 418 of the respective pipe 41 for engaging with either of a number of orifices 29 of the respective tube 28 and for securing the pipes 41 of the handle device 40 to the tubes 28 at any suitable or selected positions. The actuators 47 each includes a notch 474 for slidably receiving the tongue 462 and each includes a tapered surface 472 for engaging with the latch 46 and for disengaging the tongue 462 of the latch 46 from the orifice 29 of the tube 28 and for allowing the pipes 41 to be slided relative to the respective tubes 28 and thus for allowing the handle device 40 to be extended from the bracket 26 to the open or working position (FIG. 6). A spring 45 is engaged between the ear 414 of the pipe 41 and the actuator 47 for biasing the actuator 47 away from the latch 46.

One or more intermediate duct may further be provided and slidably engaged between the respective tubes 28 and pipes 41 for further increasing the extendible length of the handle device 40. It is to be noted that the pipes 41 of the handle device 40 are slidably secured in the tubes 28 and may be moved relative to the tubes 28. The handle device 40 may also be solidly secured to the bracket 26 or directly to the upper shell 16. The operation of the handle device 40 will not affect the movement of the upper shell 16 and the bracket 26 relative to the posts 51. The sliding engagement of the pipes 41 in the posts 51 form a two-section telescopic tube or a retractable support for the foldable suitcase; i.e., the specially designed two-section retractable support is good enough to support the suitcase in the folded and the expanded positions (FIGS. 3–6). As best shown in FIG. 5, the bar 30 is substantially located in the middle portion of the expanded suitcase body 10 and is engaged on the posts 51 such that the expanded suitcase body 10 may be solidly secured to the posts 51 and the tubes 28. U.S. Pat. No. 5,664,652 to Shamah discloses and comprises a vertically expandable handle device having at least three vertically stacked supports or tubular members secured to the luggage article. The present invention includes a two-section handle device attached to a foldable suitcase for supporting the suitcase either when the suitcase is folded or expanded.

Figure 8:
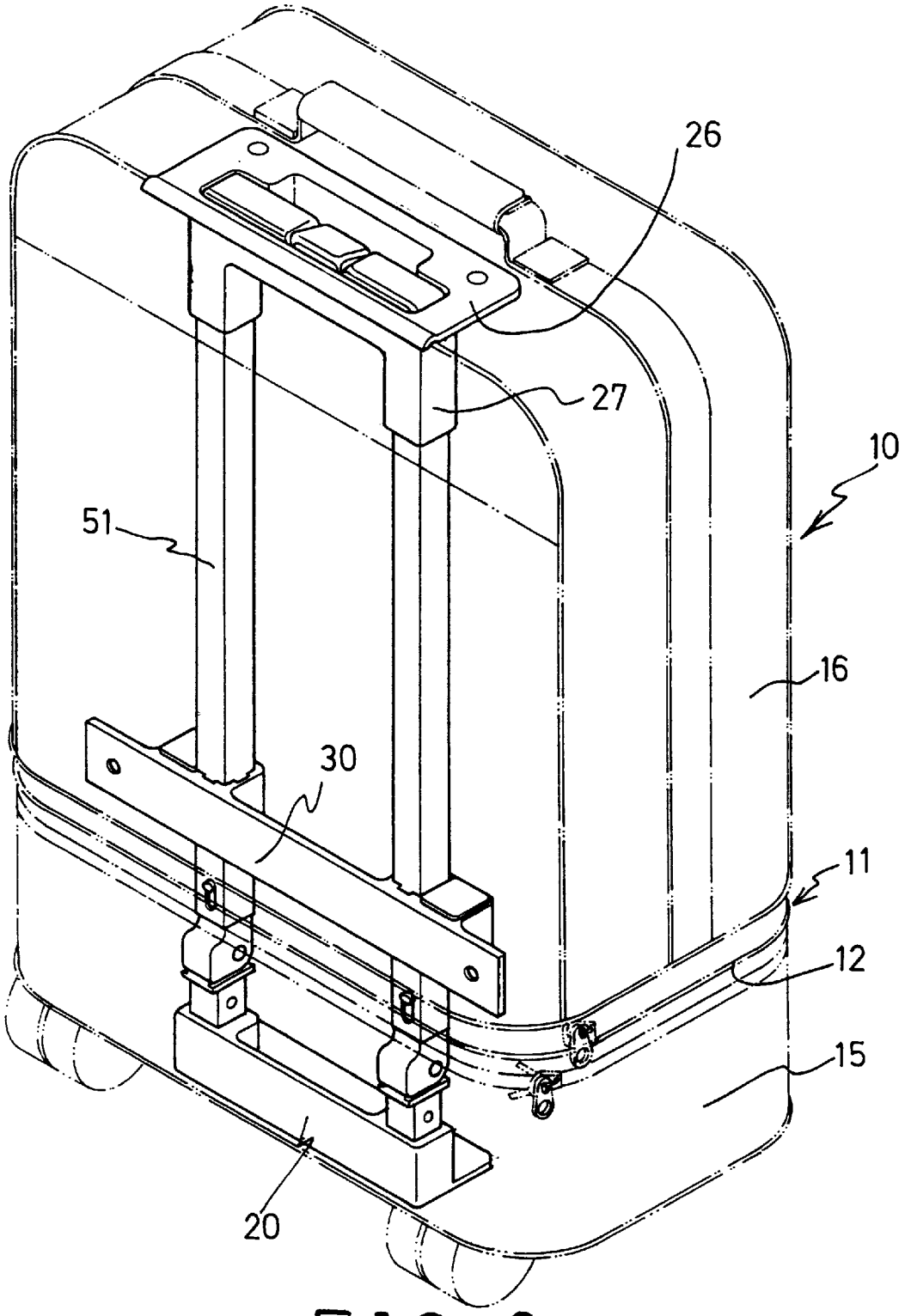
FIG. 8 is a rear perspective view illustrating the other application of the suitcase.

As shown in FIG. 8, the posts 51 and the bar 30 are preferably secured in the inner portion of the foldable suitcase 10, such that the zipper device 12 of the foldable middle portion 11 of the suitcase 10 may be exposed or will not be blocked by the posts 51, such that the zipper device 12 of the foldable middle portion 11 of the suitcase 10 may be easily operated by the users.

Figure 10:
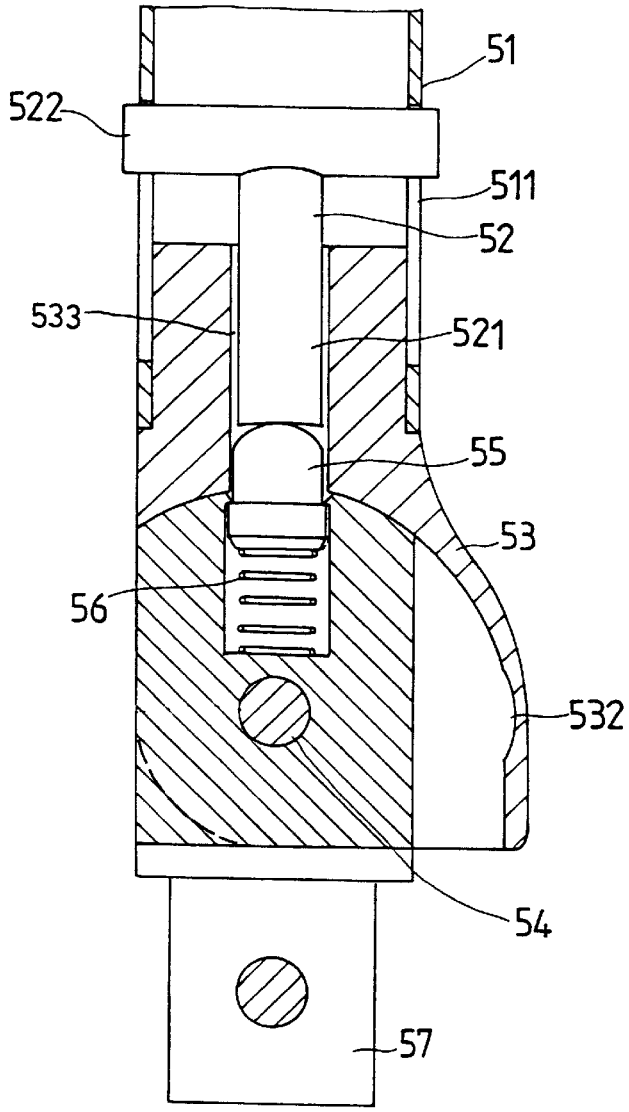
FIG. 10 is a partial cross sectional view taken along lines 10—10 of FIG. 9.
Figure 9:
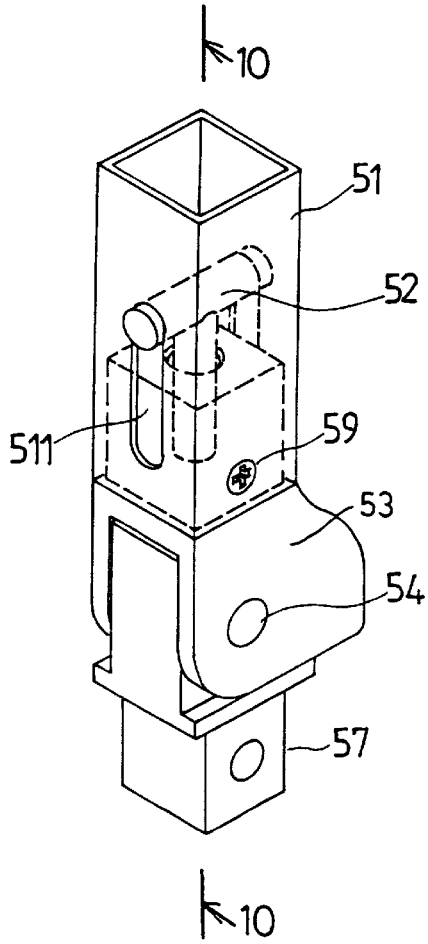
FIG. 9 is a partial perspective view of the handle device.
Figure 11:
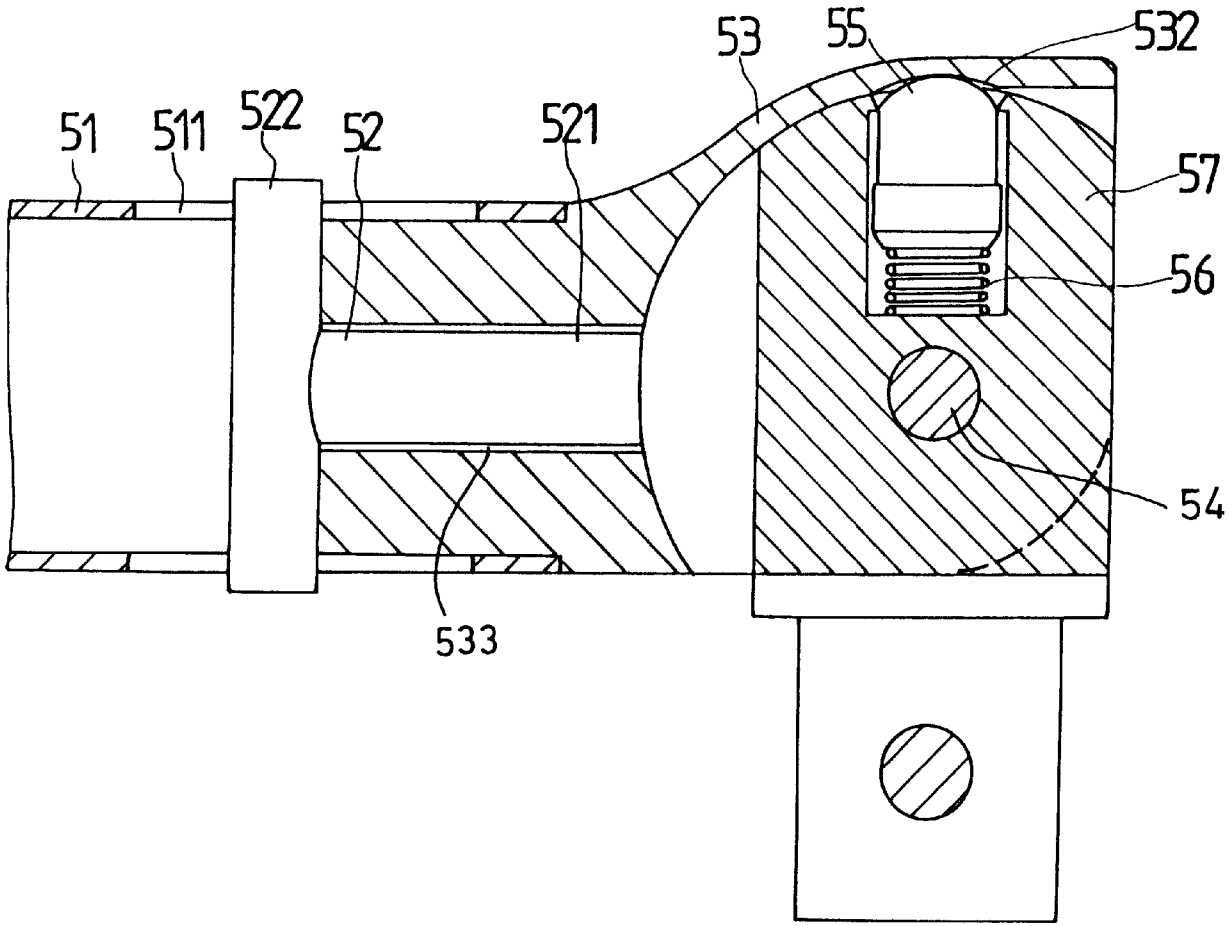
FIG. 11 is a cross sectional view similar to FIG. 10, illustrating the operation of the foldable mechanism for the handle device.

Referring next to FIGS. 9–11 and again to FIGS. 1 and 2, the posts 51 may be coupled to the base 20 with a foldable mechanism 50 which includes two frames 53 secured to the bottoms of the posts 51 by fasteners 59, for example. The posts 51 each includes one or two oblong holes 511 formed in the bottom portion thereof. Two couplers 57 are extended from the base 20 or secured to the studs 21 of the base 20 with fasteners, and each includes a cavity 58 formed in the upper portion for receiving a spring-biased projection that includes a spring 56 and a catch 55. The frame 53 includes an aperture 533 formed in the upper portion and a recess 532 formed in the lower potion (FIGS. 10, 11) and is pivotally secured to the respective coupler 57 at a pin 54. The catch 55 is biased to engage with the aperture 533 (FIG. 10 and FIGS. 3–6) for securing the post 51 at the upright position relative to the base 20, or to engage with the recess 532 (FIGS. 11) for securing the post 51 at the lay down position relative to the base 20. A knob 52 includes a lateral pole 522 slidably engaged in the oblong holes 511 of the posts 51, and includes a stick 521 slidably received in the aperture 533 of the frame 53 for disengaging the catch 55 from the aperture 533 of the frame 53 when the pole 522 of the knob 52 is depressed downward against the spring 56. One or both ends of the pole 522 of the knob 52 may be extended outward of the posts 51 for allowing the knob 52 to be depressed against the spring 56 by the user.

Figure 12:
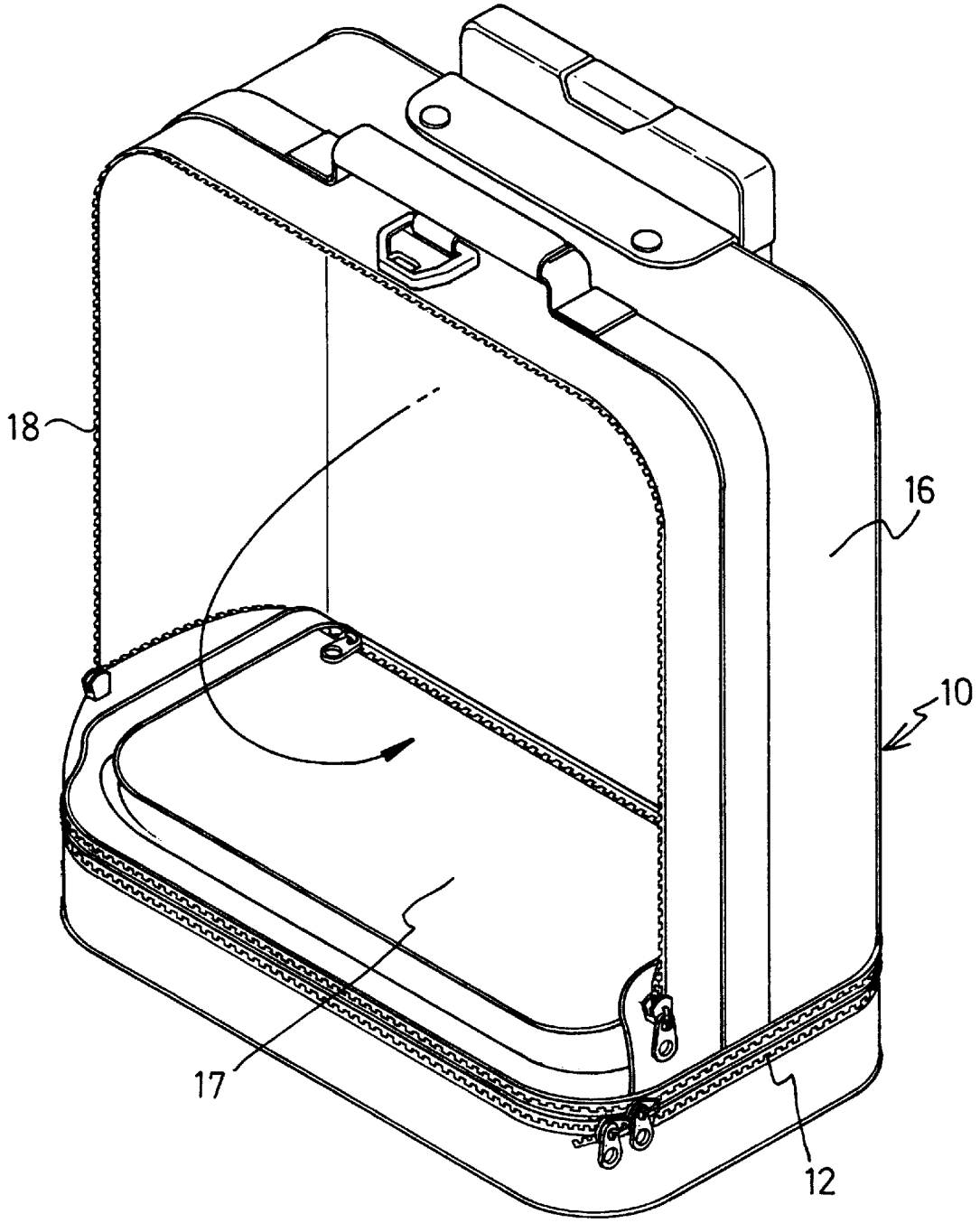
FIGS. 12, 13, 14 are perspective views illustrating the folding operation of the foldable suitcase and the handle device.
Figure 13:
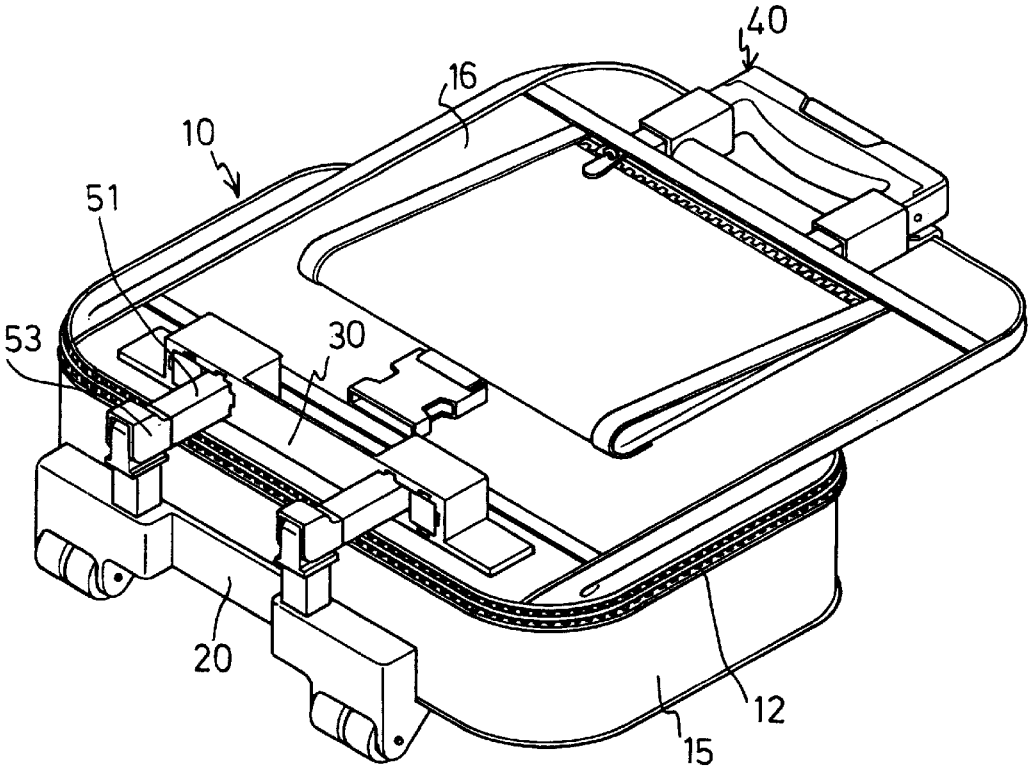
Figure 14:
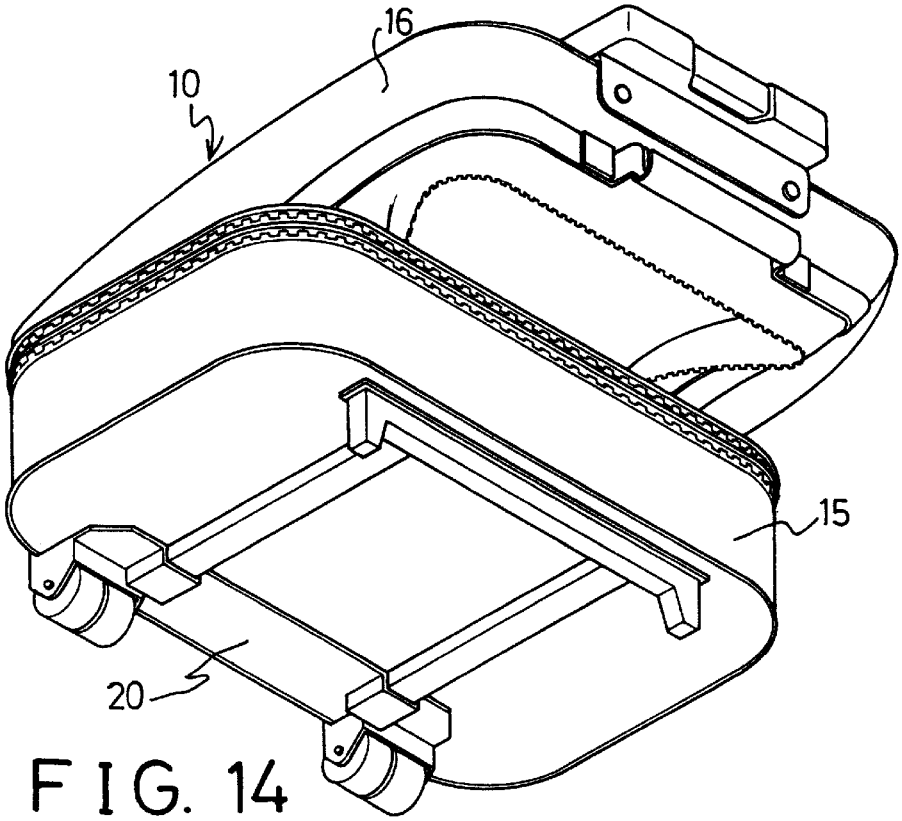

It is to be noted that the posts 51 may be rotated relative to the couplers 57 about the pin 54 for allowing the suitcase 10 to be folded to a compact configuration. For example, as shown in FIGS. 12–14, the suitcase 10 includes a foldable structure for allowing the suitcase 10 to be folded to the compact folding structure. For example, the upper shell 16 of the suitcase 10 includes a cover 17 secured to the front portion thereof with a zipper device 18 for allowing the cover 17 to be folded inward of the upper shell 16 (FIG. 12) before the upper shell 16 may be folded to the compact structure (FIGS. 13, 14).

Accordingly, the suitcase includes a retractable support retractable when the suitcase is folded and expandable when the suitcase is opened for stably supporting the suitcase at the expanded position. The retractable support or handle device and the suitcase may all be folded to a compact configuration.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

What is claimed is:

1. A suitcase comprising:

a) a suitcase body including a base and an upper shell and including a foldable middle portion provided between said base and said upper shell for forming a foldable structure to said suitcase body and for allowing said suitcase body to be expanded to a working position and to be folded to a folded position, said upper shell of said suitcase body including an upper portion and a lower portion, b) a wheel device secured to said base of said suitcase body, c) a retractable support secured to said upper shell of said suitcase body for supporting said suitcase body at said working position and at said folded position respectively, said retractable support including:

i) a pair of posts having a lower portion secured to said base of said suitcase body, ii) a bracket secured to said upper portion of said upper shell, said bracket including a pair of tubes extended therefrom and slidably received in said posts respectively, said bracket being secured to said upper shell such that said bracket and thus said tubes and said upper shell are moved in concert with each other and movable up and down relative to said posts, and iii) a bar secured to said lower portion of said upper shell of said suitcase body and including a pair of orifices for slidably receiving said posts respectively and for slidably securing said upper shell to said posts, said bar including at least one block secured therein, d) a handle device attached to said upper shell for carrying said suitcase, said handle device including:

i) a pair of pipes slidably received in said tubes respectively and moved relative to said tubes between an extended position and a retracted position, ii) a hand grip provided between said pipes, and iii) means for selectively securing said pipes at said extended position and said retracted position relative to said tubes, e) means for securing said posts to said bar, said securing means including at least one hole formed in a first of said posts, a spring-biased projection received in said at least one block of said bar and engaged with said at least one hole of said first post for securing said first post to said bar.

* * * * *